US005992128A

United States Patent [19]

Langerak

[11] Patent Number: 5,992,128

[45] Date of Patent: Nov. 30, 1999

[54] SYSTEM FOR GIRDING ARTICLES

[75] Inventor: Alfred Langerak, Mijnsheerenland, Netherlands

[73] Assignee: InnoSeal Systems International B.V., Netherlands

[21] Appl. No.: 08/992,867

[22] Filed: Dec. 11, 1997

Related U.S. Application Data

[63] Continuation-in-part of application No. PCT/NL96/00233, Jun. 11, 1996.

[30] Foreign Application Priority Data

Jun. 12, 1995 [NL] Netherlands ..... 1000546

[51] Int. Cl.[6] ..... B65B 51/08

[52] U.S. Cl. ..... 53/137.2; 53/139.1; 53/583; 242/606; 242/614

[58] Field of Search ..... 53/139.1, 137.2, 53/583; 242/606, 614, 613, 176, 613.1, 118; 156/483; 206/411, 414

[56] References Cited

U.S. PATENT DOCUMENTS

| | | | |
|---|---|---|---|
| 3,486,709 | 12/1969 | Roberson | 242/614 |
| 3,625,799 | 12/1971 | Way . | |
| 3,670,986 | 6/1972 | Farkas . | |
| 4,088,278 | 5/1978 | Adair | 242/614 |
| 4,718,220 | 1/1988 | Van Rosendal et al. | 53/583 |
| 5,295,345 | 3/1994 | Ter Haar | 53/583 |

FOREIGN PATENT DOCUMENTS

| | | |
|---|---|---|
| 0 188 843 A1 | 7/1986 | European Pat. Off. . |
| 2 037 645 | 3/1971 | Germany . |

*Primary Examiner*—Linda Johnson
*Attorney, Agent, or Firm*—Gardner & Groff, P.C.

[57] ABSTRACT

A system for girding an article, in particular the twisted end of a bag, with a closure including a strip of adhesive tape. The system comprises a girding device and a roll of adhesive tape having a core. The girding device comprises a housing including a slot which is adapted for receiving the article moving therethrough. The housing also is provided with a support post for rotatably supporting a roll of adhesive tape. A star wheel is mounted for rotation at one side of the slot and has radially extending spokes which extend over the slot and are separated by recesses suitable for accommodating a twisted end of the article as it is moved through the slot past the star wheel. The housing further includes an element which lies at an opposite side of the slot from that of the star wheel and thereat forms a wall part lying along the path of ends of the spokes of the star wheel. A severing mechanism is provided for severing a strip of adhesive tape after the article has passed the star wheel. The housing of the girding device adjacent the roll of adhesive tape during normal operation of the girding device is provided with a tongue which projects toward the core of the roll, with one side of the core of the roll of tape being provided with a circumferential groove into which the tongue means can project so that the roll of tape can turn freely when mounted with the tongue registering with the circumferential groove. The housing includes a movable cover and wherein in one orientation the roll of tape can be fully seated on its support means and in another orientation the roll of tape cannot be fully seated, and wherein the cover is provided with lug means to prevent the cover from fully closing if the roll of tape is not fully seated.

9 Claims, 3 Drawing Sheets

SYSTEM FOR GIRDING ARTICLES

This application is a CIP of international application number PCT/NL96/00233, filed Jun. 11, 1996.

TECHNICAL FIELD

The present invention relates to a system for girding articles, in particular the twisted necks of filled plastic bags.

BACKGROUND OF THE INVENTION

Systems for closing bags and the like are known from, inter alia, U.S. Pat. Nos. 3,729,896 and 4,718,220. These manually operated bag-closing devices are currently used for domestic purposes in particular. With the device according to U.S. Pat. No. 3,729,896, a closure consisting of a single strip of self-adhesive tape is applied around the twisted neck of a bag. With the device according to U.S. Pat. No. 4,718,220, the ends of the self-adhesive tape facing away from the neck of the bag are covered with a strip of paper tape, which greatly facilitates the reopening of the bag.

It is noted that U.S. Pat. No. 3,670,986 discloses a heat seal type banding machine comprising keying means that prevent mounting of a roll of tape in an incorrect position in the machine. These known keying means, however, prevent a free rotation between the banding machine and the part of the roll of tape on which the keying means operate. This has the consequence that the core of the roll of tape at least must be built up out of two parts that are rotatable relative to one another.

SUMMARY OF THE INVENTION

A primary object of the present invention is to improve the known systems, and in particular to make them more suitable and acceptable for professional applications such as in the retail trade or in industry. In industry such devices can also be used for, for example, girding a bunch of cables.

This object is achieved according to the present invention by providing a girding system for girding an article and including a girding device and a roll of tape, which is characterized in that the girding device and the roll of adhesive tape and/or the roll of paper tape are designed in such a way that the roll in question can be placed in only one position in the girding device.

Preferably, the system is provided for girding an article, in particular the twisted end of a bag, with a closure including a strip of adhesive tape. The system comprises a girding device and a roll of adhesive tape having a core. The girding device comprises a housing including a slot which is adapted for receiving the article moving therethrough. The housing also is provided with support means for rotatably supporting a roll of adhesive tape. Means are provided at one side of the slot for rotatably supporting the star wheel with a star wheel mounted thereon and having radially extending spokes which extend over the slot and are separated by recesses suitable for accommodating a twisted end of the article as it is moved through the slot past the star wheel. The housing further includes an element which lies at an opposite side of the slot from that of the star wheel and thereat forms a wall part lying along the path of ends of the spokes of the star wheel. Severing means are provided for severing a strip of adhesive tape after the article has passed the star wheel. The housing of the girding device adjacent the roll of adhesive tape during normal operation of the girding device is provided with tongue means which project toward the core of the roll, with one side of the core of the roll of tape being provided with a circumferential groove into which the tongue means can project so that the roll of tape can turn freely when mounted with the tongue means registering with the circumferential groove. Preferably, the tongue means comprise an annular ring formed on the housing. Also preferably, the housing includes a movable cover and wherein in one orientation the roll of tape can be fully seated on its support means and in another orientation the roll of tape cannot be fully seated, and wherein the cover is provided with lug means to prevent the cover from fully closing if the roll of tape is not fully seated.

The invention is based on the fact that the roll of tape often runs out at times when the device is being used the most intensively. This means that the empty roll then has to be quickly exchanged for a new roll, for example in the retail trade when customers are standing waiting in the shop. However, the known systems allow the roll of adhesive tape, and also the roll of paper tape if present, to be placed in an incorrect position in the girding device in the first instance, so that the device jams during the next use. The correction then needed leads to time loss and irritation. This inefficiency of this system in practice has led to other, more expensive and more time-consuming ways of closing bags, for example by means of loose plastic clips, being used on an increasingly large scale.

Although it is not difficult per se to place a loose roll of tape correctly in the girding device, where such systems are being used in, for example, the retail trade, another problem is the fact that a large number of the personnel are employed only temporarily, and are consequently unfamiliar with the way in which the device works. An important advantage of the invention is that no experience or knowledge of the system whatsoever is necessary for replacing the loose roll or rolls of tape quickly and without any problems.

It is clear that the ideas of the invention can be achieved in many different ways, for example by arranging for a wall of the device situated next to the roll of tape during normal operation of the device to be provided with tongue means pointing towards the roll, and by making the core of the roll of tape in such a way that the side intended for lying along the wall of the device it is provided with a circumferential groove into which the tongue means project, and at the opposite side making it in such a way that the tongue means cannot project into the core there.

The system according to the invention does not need a two-part core for the roll of tape as in U.S. Pat. No. 3,670,986. This is because the interaction between the tongue means in the girding device and the circumferential groove on one particular side of the core of the roll of tape still gives freedom to the roll of tape to turn freely relative to the tongue means. This makes the solution according to the invention for preventing that a roll of tape can be placed in the incorrect position in a girding device much more simple and cheaper than the keying means according to U.S. Pat. No. 3,670,986.

In a specific embodiment according to the invention, the tongue means can be formed by an annular wall, projecting from the wall in question. In another embodiment the tongue means can consist of individual tongues arranged in a circle.

The idea of the invention is particularly advantageous in the case of a girding device of the type described in U.S. Pat. No. 4,718,220, in particular if the idea of the invention is being used to ensure that it is not possible to place the loose roll of paper tape in the incorrect position in the device. For if the roll of adhesive tape is placed incorrectly, the fact that the device is not functioning will make it clear that a mistake has been made, but the roll of paper tape will still unroll in the wrong position. In practice, however, there is the risk that if the roll of paper tape is placed incorrectly, the easily tearing paper tape in the device may run over a sharp corner not intended for it, and will then still tear as a result of the jerking movements exerted on the paper tape during use.

BRIEF DESCRIPTION OF THE DRAWING FIGURES

The present invention will be explained in greater detail below with reference to the appended drawings, in which.

DETAILED DESCRIPTION OF THE PREFERRED EMBODIMENT

Figure 1:
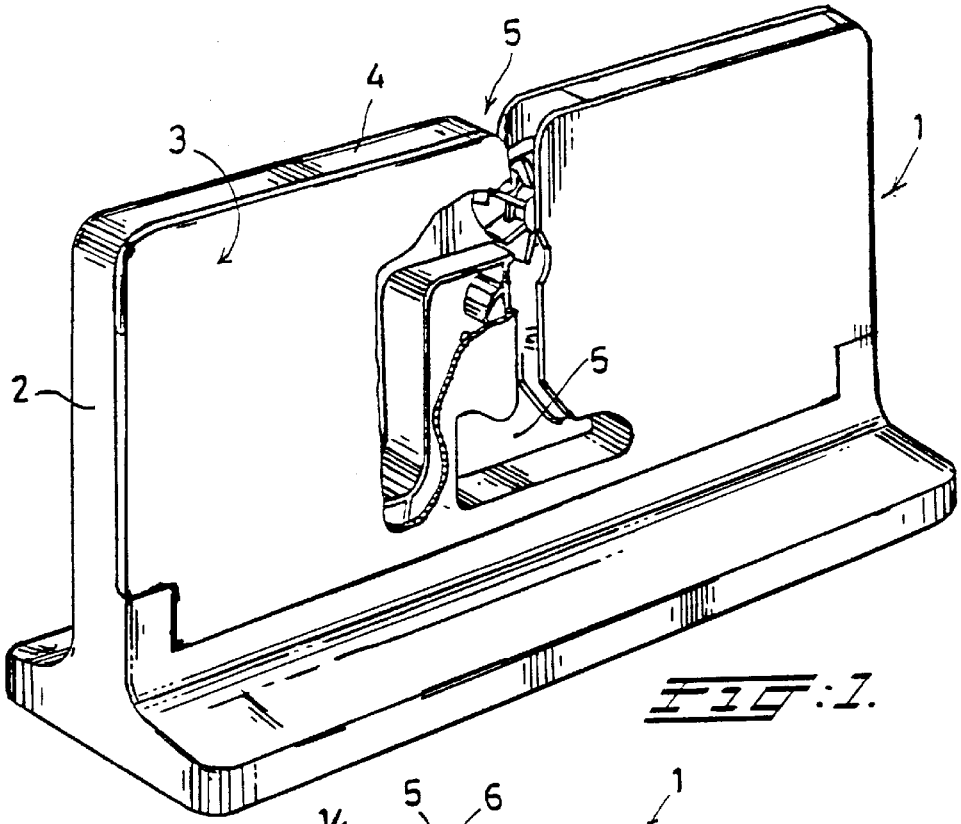
FIG. 1 shows a view in perspective, partially cut away, of a girding device of the system according to the invention.
Figure 2:
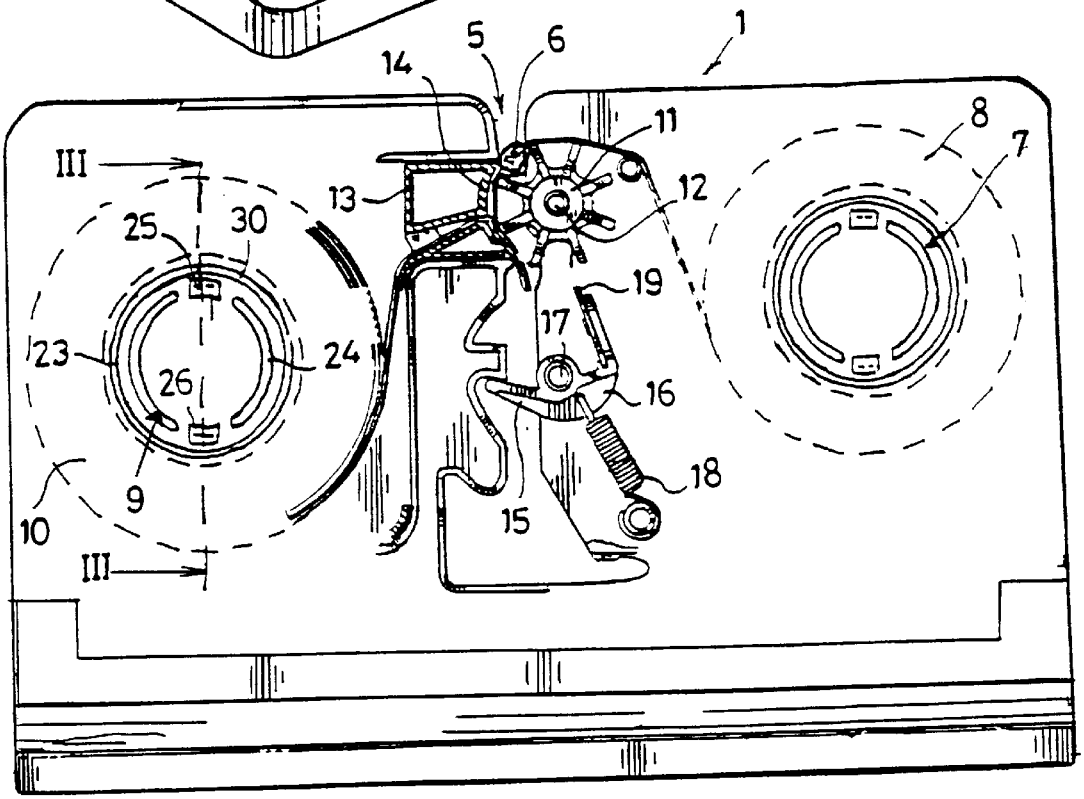
FIG. 2 shows a side view of the device in FIG. 1, in which the fold-down wall thereof is omitted.

FIGS. 1 and 2 show a girding device 1 according to the invention, having a plastic housing 4 which consists of a housing part 2 with support foot and a cover 3 (shown only in FIG. 1) which is fitted on the housing part 2 in such a way that it hinges about a hinge pin situated near the bottom edge thereof. The housing 4 has a slot 5, beginning at the top side thereof and extending in the direction of the support foot, through which slot a twisted, or otherwise compressed, neck 6 of a bag is moved from top to bottom, in order place a closure around the neck 6 of the bag.

The housing 4 is provided with a support 7 for rotatably supporting a roll of single-sided adhesive tape 8, which is indicated by dashed lines in FIG. 2. The housing 4 is also provided with an essentially identically designed support 9, for rotatably supporting a roll of paper tape 10, which is likewise indicated only by dashed lines in FIG. 2.

The device also comprises a star wheel 11 with radially extending spokes, between which recesses are present, in which recesses the neck 6 of the bag to be closed comes to lie while passing the star wheel 11. The star wheel 11 is rotatably mounted on a shaft 12 formed on the housing part 3, in such a way that the spokes of the star wheel 11 extend over the slot 5 up to the other side of the slot 5. At that side the housing part 3 contains an element 13 which forms a curved wall part 14 situated near the path of the tips of the spokes of the star wheel 11.

Past the star wheel 11, viewed in the direction of movement of the neck 6 of the bag, a tilting arm 15 extends over the slot 5, which tilting arm 15 forms part of cutting element 16. The cutting element 16 is tiltable about a shaft 17 fixed securely to the housing part 3, and is held in the position shown in FIG. 2 by means of a return spring 18. When the neck 6 of the bag pushes away the tilting arm 15 out of the slot 5, a cutter 19 fitted on the cutting element 16 moves into the slot and severs the closure formed around the neck 6. For a detailed description of the operation of the device and the formation of the closure around the neck 6 of the bag, reference is made here to U.S. Pat. No. 4,718,220.

The invention will now be explained with reference to FIGS. 2 and 3. It is pointed out here that the supports of the roll of paper tape and the roll of adhesive tape, and also the cores of both rolls, in this exemplary embodiment of the system according to the invention are of generally identical design, which is the reason why a description will suffice of the way in which the roll of paper tape and the parts of the device interacting therewith are designed.

Figure 3:
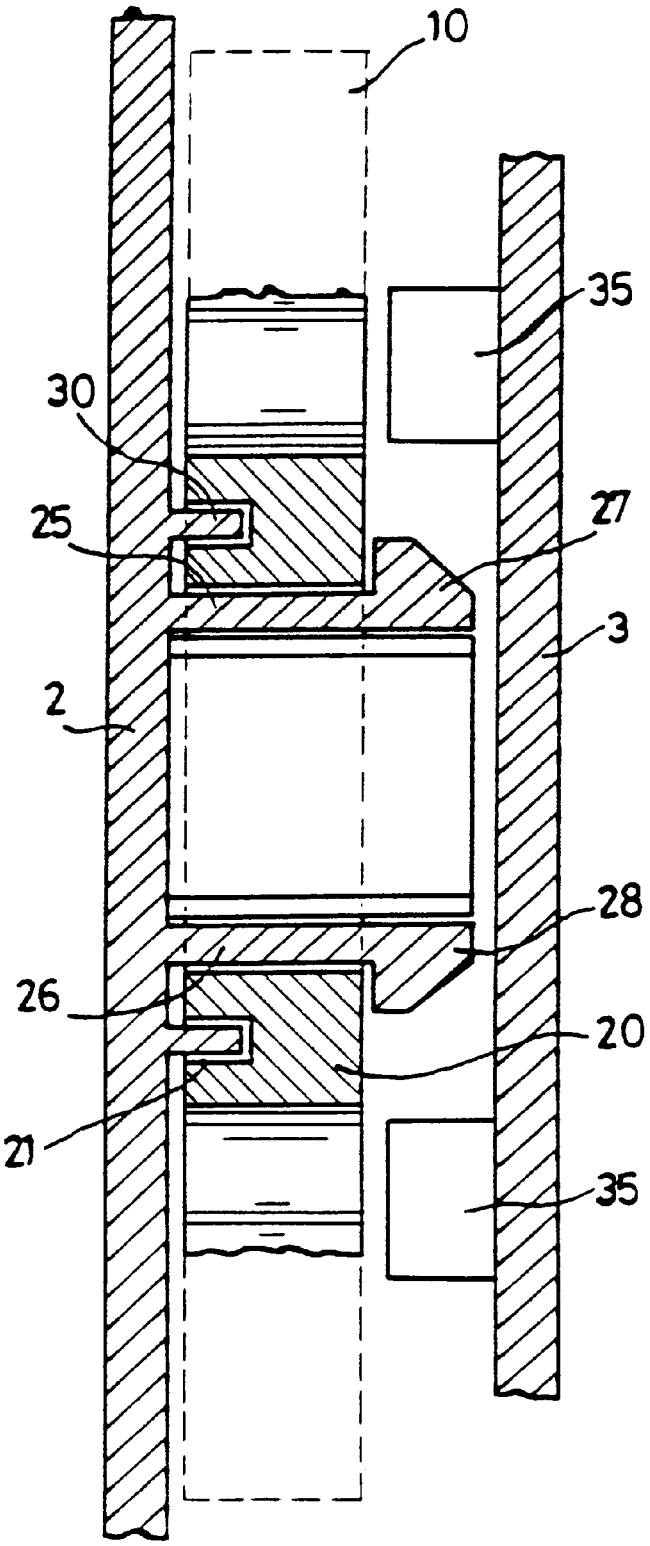
FIG. 3 is a section along the line III—III in FIG. 2 during normal use of the system according to the present invention.

It can be seen in FIG. 3 that the paper tape 10 is wound onto a core 20. The core 20 is a plastic ring in which a circumferential groove 21 is formed at one of the two sides situated at right angles to the axis of rotation, while the opposite side of the core 20 is of essentially closed design, and in particular is not provided with an equally deep or even deeper circumferential groove. The core 20 has a cylindrical bore with a standard internal diameter, in particular up to 2.5 inches.

For rotatably supporting the roll of tape 10, parts which can project into the bore of the core 20 are formed in the manner known per se on the housing part 2. These are two curved wall parts 23 and 24 which are disposed in a rigid manner diametrically opposite each other on the housing part 2, and also two resilient lips 25 and 26 situated diametrically opposite each other. The lips 25 and 26 each bear at their free end an outwardly projecting thickened part 27 and 28 respectively. When the core 20 is inserted over these parts 23, 24, 25 and 26, the lips 25 and 26 first move inwardly, and then move outwardly again, and grip with their thickened parts 27 and 28 respectively over the core 20, thus holding the core 20 in place.

An inwardly projecting annular wall 30, lying around the outside of the parts 23, 24, 25 and 26 projecting into the bore of the core 20, is formed on the inside wall of the housing part 2. The annular wall 30 is of such dimensions and is placed in such a way that the annular wall 30 projects into the groove 21 of the core 20 if the roll of tape 10 has been placed in the correct position in the device. In this correct position, shown in FIG. 3, the roll of tape can rotate with slight friction.

If a mistaken attempt is made to place the roll of tape the other way round in the device, the roll of tape cannot be inserted so far onto the parts 23, 24, 25 and 26 that the thickened parts 27 and 28 of the resilient lips 25 and 26 can grip behind the core 20. This means that the roll of tape is not held in place, which becomes clear to the person placing the roll of tape, who can immediately correct his mistake. Besides, in this incorrect position of the roll of tape, the tape runs crooked in the device, which is very obvious and must also be avoided, because in particular in the case of the paper tape this leads irrevocably to tearing of the tape. However, should the visibly incorrect position of the roll of tape escape the attention of the person, he or she will then find that the cover 3 will not close. This is achieved by the fact that the cover 3 is designed in such a way that it can be closed only if the roll of tape 10 is situated in its correct position. In this exemplary embodiment this is achieved by forming lugs 35 on the inside of the cover 3, which lugs lie next to the roll of tape 10 when the device is closed.

As a result of the groove 21 disposed asymmetrically in the core 20, it is necessary to place the core 20 in the correct position in the tape winding machine when the tape is being wound onto the core 20.

Figure 3A:
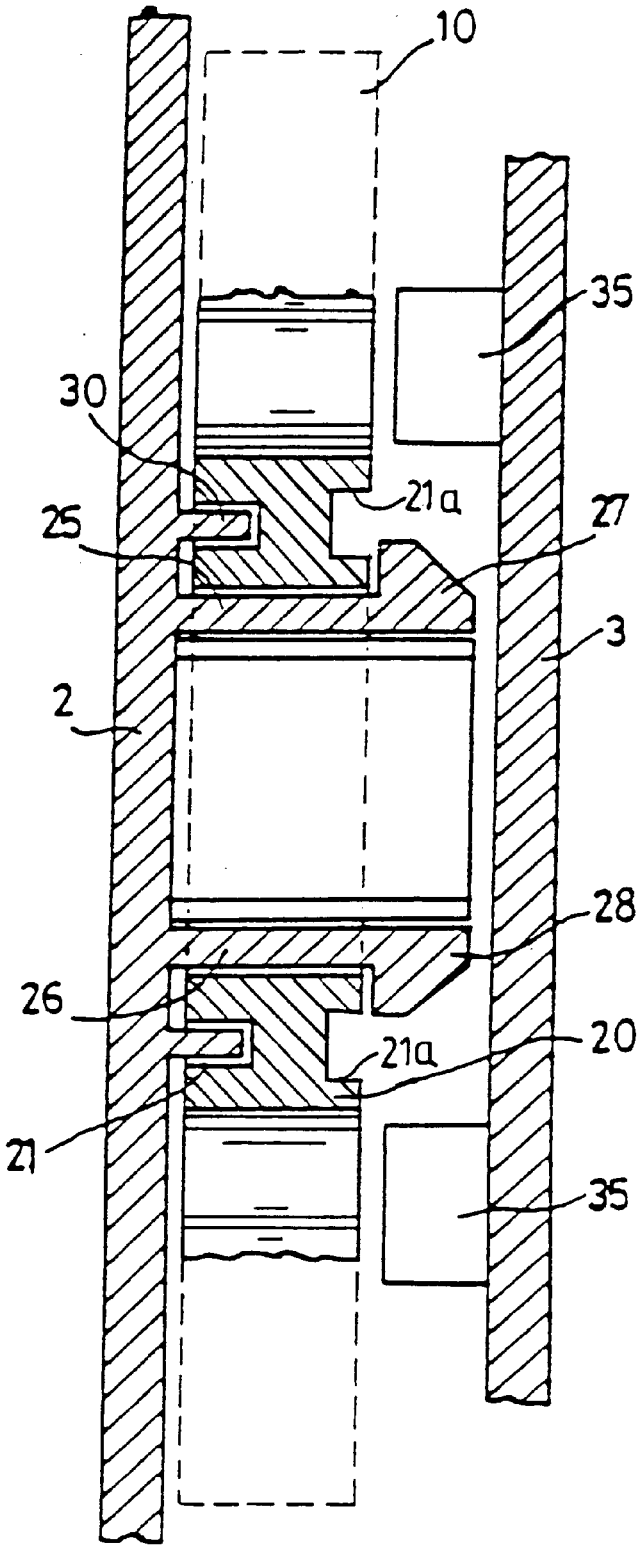
FIG. 3A shows the girding system of FIG. 3 in a slightly modified form.

FIG. 3A shows a system for girding articles according to a slightly modified form of the invention. As shown in FIG. 3A, the roll of tape has a circumferential groove 21, as before. However, a second groove 21*a* is provided at the opposite side of the roll of tape. The second groove is provided in order to maintain the dynamic balance of the roll of tape during the manufacturing process. It is noted here that during manufacturing the reel receives tape at a relatively high speed. This high speed rotation of the reel can cause wobbling and poor tape winding if the reel is not maintained in good balance. To that end, the second groove 21*a* on the opposite side eliminates a like amount of material as does groove 21 in order to keep the reel balanced as it is wound with tape. In order that the important advantage of allowing the roll of tape to only be mounted one way in the system, the depth of the second circumferential groove 21*a* is not as great as that of the first circumferential groove 21. Alternatively, the width of the second groove 21*a* could be narrowed to prevent the circumferential wall 30 from fitting within the groove 21*a*. It is also possible to make the grooves of substantially the same depth, but to provide radially extending walls in the groove 21*a* to prevent the circumferential wall 30 from reaching to the very bottom of the groove 21*a*. Also, the profile of the grooves can be different. For example, groove 21 could be a tapered groove for receiving a tapered circumferential wall 30, while groove 21*a* could be non-tapered to prevent the tapered groove from being fitted therein.

From the above description it can be appreciated that by relatively simple means it can be made impossible to place the roll of tape incorrectly in the device. As a result of this improvement, the system is particularly suitable for intensive applications where the roll or the rolls of tape have to be changed often and quickly by persons who know little or nothing about the operation of such closure systems, such as in the retail trade or industry.

While the invention has been disclosed in a preferred form, it will be apparent to those skilled in the art that many modifications, additions, and deletions can be made therein without departing from the spirit and scope of the invention as set forth in the following appended claims.

What is claimed is:

1. A system for girding an article, with a closure including a strip of adhesive tape, said system comprising a girding device and a roll of adhesive tape having a core, and wherein said girding device comprises a housing provided with a slot which is adapted for receiving the article moving therethrough, wherein said housing is also provided with first support means for rotatably supporting said roll of adhesive tape, and star wheel support means situated at one side of said slot for rotatably supporting a star wheel, a star wheel disposed thereon and including radially extending spokes which extend over said slot and are separated by recesses which are suitable for accommodating an end of the article when it is being moved through said slot past said star wheel, wherein said housing is further provided with an element which lies at an opposite side of said slot from that of said star wheel and there forms a wall part lying along the path of ends of said spokes of said star wheel, and also means for severing a strip of adhesive tape after the article has passed said star wheel, and wherein a wall of said girding device situated next to said roll of adhesive tape during normal operation of said girding device is provided with tongue means projecting towards said core of said roll of adhesive tape, with one side of said core of said roll of adhesive tape at the side intended for lying along said wall of the girding device being provided with a circumferential groove into which said tongue means can project so that said roll of adhesive tape can turn freely, and an opposite side of said core being such that said tongue means cannot project into said opposite side for preventing said roll of adhesive tape from turning freely.

2. A system according to claim 1, further comprising a roll of paper tape and wherein said housing further comprises second support means for rotatably supporting said roll of paper tape.

3. A system according to claim 1, in which said tongue means comprises an annular ring on said housing wall.

4. A system according to claim 1, wherein said housing includes a movable cover having lug means for preventing said movable cover from closing completely when a roll of adhesive tape is incorrectly mounted on said first support means.

5. A girding device for girding an article with a closure including a strip of adhesive tape, said girding device comprising a housing provided with a slot which is adapted for moving the article through it, said housing further being provided with first support means for rotatably supporting a roll of adhesive tape, and star wheel support means situated at one side of said slot for rotatably supporting a star wheel, a star wheel disposed on said star wheel support means, said star wheel comprising radially extending spokes which extend over said slot and are separated by recesses which are suitable for accommodating the article when it is being moved through said slot thereby passing said star wheel, said housing further being provided with an element which lies at the other side of said slot from that of said star wheel and there forms a wall part lying along a path of the ends of the spokes of said star wheel, said device further comprising means for severing the strip of adhesive tape after the article has passed said star wheel, wherein a wall of said housing situated next to a roll of adhesive tape during normal operation of said girding device is provided with tongue means projecting towards a core of said roll of adhesive tape, said core of said roll of adhesive tape having a circumferential groove present at the side of said core intended for lying along said wall of said girding device, and wherein with said tongue means received in said circumferential groove said roll of adhesive tape can turn freely.

6. A girding device according to claim 5, wherein said housing is further provided with second support means for rotatably supporting a roll of paper tape and a roll of paper tape mounted thereon.

7. A roll of adhesive tape for mounting to a support device, said roll of adhesive tape comprising: an essentially solid cylindrical core and a ring-shaped circumferential groove at one of the two sides situated at right angles to an axis of rotation of said core, said groove being of open design around the entire circumference, the other side of said core not having a similarly shaped or dimensioned groove, and wherein in use a tongue means of the support device can project into said ring-shaped circumferential groove such that said roll of adhesive tape can turn freely with respect to the tongue means.

8. A roll of adhesive tape according to claim 7, in which said opposite side of said core is essentially closed.

9. A roll of adhesive tape according to claim 7, in which said opposite side of said core is provided with a groove which is less deep than said annular groove.

* * * * *